US006448941B1

(12) United States Patent
Adams et al.

(10) Patent No.: US 6,448,941 B1
(45) Date of Patent: Sep. 10, 2002

(54) METHOD FOR SECURE COMMUNICATIONS USING SPIRAL ANTENNAS

(75) Inventors: Richard C. Adams, San Diego; Howard E. Rast, Solana Beach, both of CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/295,950

(22) Filed: Apr. 21, 1999

(51) Int. Cl.[7] ..... H01Q 1/36
(52) U.S. Cl. ..... 343/895; 343/700 MS
(58) Field of Search ..... 343/700 MS, 792.5, 343/895; 455/7, 39

(56) References Cited

U.S. PATENT DOCUMENTS

| | | | | |
|---|---|---|---|---|
| 4,387,379 A | | 6/1983 | Hardie | 343/895 |
| 5,227,807 A | * | 7/1993 | Bohlman et al. | 343/895 |
| 5,313,216 A | | 5/1994 | Wang et al. | 343/700 MS |
| 5,451,973 A | | 9/1995 | Walter et al. | 343/895 |
| 5,477,232 A | * | 12/1995 | Yamamoto | 343/713 |
| 5,508,710 A | | 4/1996 | Wang et al. | 343/726 |
| 5,712,647 A | | 1/1998 | Shively | 343/895 |
| 5,808,587 A | * | 9/1998 | Shima | 340/10.34 |
| 6,300,918 B1 | * | 10/2001 | Riddle et al. | 343/855 |

* cited by examiner

*Primary Examiner*—Tan Ho
(74) *Attorney, Agent, or Firm*—Peter A. Lipovsky; Michael A. Kagan; James A. Ward

(57) ABSTRACT

A method for communicating with a decreased probability of detection by an unintended listening party uses frequency hopping and two substantially identical linearly polarized antennas whose polarization vector is synchronized to frequency. Synchronization of polarization with frequency is accomplished through specifically designed conductor-backed spiral antennas. For these conductor-backed spiral antennas, a change in frequency is synchronized to a change in the polarization vector of the communication signal. Since the receiving station will be programmed to alter its reception frequencies in accordance with those being transmitted, the second spiral antenna will automatically change its polarization upon making these frequency changes. A rapid change of polarization increases the difficulty in detecting and intercepting the communication by parties for whom the message was not intended.

17 Claims, 6 Drawing Sheets

COORDINATE SYSTEM USED

IN THE $\phi = 0^0$ PLANE $E_H = |E_\theta|$ $E_V = |E_\phi|$

METHOD FOR SECURE COMMUNICATIONS USING SPIRAL ANTENNAS

BACKGROUND OF THE INVENTION

This invention relates generally to communications and more specifically to communications accomplished via spiral antennas. More specifically, the invention relates to utilizing a spiral antenna design that enhances the security of spiral antenna transmission and reception. With greater specificity, but without limitation thereto, the invention relates to using a linearly polarized, conductor-backed, spiral antenna that alters its polarization vector upon a change in frequency.

A great variety of methods have been used and are used to thwart undesired eavesdropping of communications. One such method, credited to past U.S. screen star Heddy Lamar, is the use of frequency hopping. In a frequency-hopped communication, the signal is broadcast over a specific sequence of channels, varying from one frequency band to another. The receiving station knows a-head-of-time the sequence of channels and the specific time at which the channels will be changed. Accordingly, the receiving station can follow and hence intelligently receive a transmission from the frequency-hopped transmission station. Of course, though, the opposite would occur for an unintended listener that does not have the proposed sequence of channels and the timing of the channel switches. It could thus prove difficult for an eavesdropper to be able to overhear a coherent communication signal as, at best, bits and pieces of the communication would be detected.

To improve the eavesdropping of frequency-hopped signals, broad-band, linearly polarized antennas have been employed. One such antenna, the log periodic, is known however to experience limitations when a frequency-hopped signal changes polarization. In such a circumstance, the log periodic antenna could follow the changes in frequency, but not in polarization.

Although two orthogonal log periodic antennas could be used to further enhance eavesdropping, rapid changes in transmission polarization could severely complicate signal detection and interception. This will be true in most cases because of the usual time delay between a signal impinging upon an antenna and the reception equipment registering a detection. Even if crossed log periodic antennas had frequency sensitivity to all polarizations, a combination of frequency and polarization diversity could cause a signal to fail to register a detection. The eavesdropping party could not follow the changes with sensitive enough equipment to still exclude common noise.

There is therefore a need within the art of communications to provide an enhanced method of communicating that accomplishes both frequency and polarization variation.

SUMMARY OF THE INVENTION

The invention provides a method for communicating with a decreased probability of detection by an unintended listening party. The method uses frequency hopping and two substantially identical linearly polarized antennas whose polarization vector is synchronized to frequency. Synchronization of polarization with frequency is accomplished through specifically designed conductor-backed spiral antennas. For these conductor-backed spiral antennas, a change in frequency is synchronized to a change in the polarization vector of the communication signal. Since the receiving station will be programmed to alter its reception frequencies in accordance with those being transmitted, the second spiral antenna will automatically change its polarization upon making these frequency changes. A rapid change of polarization increases the difficulty in detecting and intercepting the communication by parties for whom the message was not intended.

Accordingly, it is an object of this invention to provide a communication method for enhancing the security of communications or, put another way, for frustrating the attempts of eavesdroppers from overhearing communications not intended for them.

A further object of this invention is to provide a communication method that employs both frequency hopping and polarization changing to enhance the security of communications utilizing this communication method.

Yet another object of this invention is to meet the above, objects in a simple way.

Still a further object of this invention is to provide a communication method that meets the above objects and that uses spiral antennas.

Other objects, advantages and new features of the invention will become apparent from the following detailed description of the invention when considered in conjunction with the accompanying drawings.

DESCRIPTION OF THE PREFERRED EMBODIMENT

Research conducted by the U.S. Navy on antennas has indicated that a distinct change in polarization could be realized for specific spiral antennas of conductor-backed design. No acknowledgment of this effect has been attributed to spiral antennas of cavity-backed designs.

The Navy study found that the number of turns of an antenna element of a conductor-backed spiral antenna affects the frequency over which a polarization change can be realized. In general, increasing the number of turns of the spiral increases the occurrence of polarization changes for a given frequency range. It was also learned that in general the thickness of the dielectric layer between the spiral radiating elements and the conductor backing determines the magnitude (change in dB) of the polarization effect. For a conductor-backed spiral antenna with a relatively thin dielectric layer, a small change in frequency can cause a relatively large change in polarization. The studies were conducted on two-arm spirals. It is envisioned, however, that similar effects may also be attributable to conductor-backed spiral antennas having more than two spiral arms.

Figure 1A:
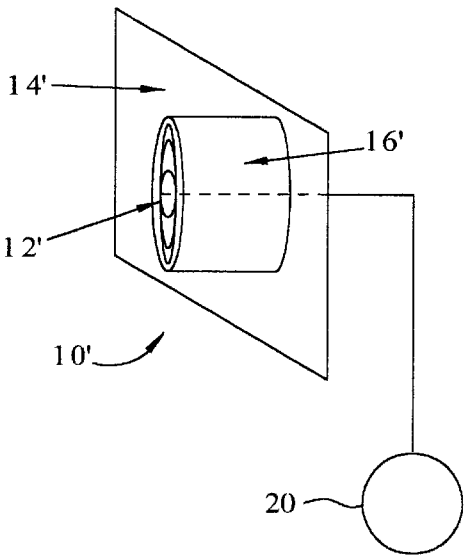
FIGS. 1A–C illustrate an exemplary schematic of the method of the invention.

Referring now to FIG. 1A, a method of implementation of the invention is shown in which two substantially identical, linearly polarized, conductor-backed spiral antennas 10 and 10' are used. The antennas should be designed and fabricated to be substantially identical in physical features, resulting also in a duplication of performance characteristics. The spiral antennas will be described in greater detail. In general, the antennas include at least a pair of spiral radiating elements or arms 12 and 12'. As mentioned above, antennas having two-armed spirals have been successfully employed to achieve desired polarization characteristics. It is also envisioned that spiral antennas containing a greater number of arms may also exhibit similar polarization performance characteristics. In the spiral antennas employed, the spiral radiating elements followed an Archimedean path and had two foot diameters of a variety of turns. As is well understood in the art of spiral antennas, the gap between the array and the maximum diameter of the spirals are determined by the minimum and maximum frequencies anticipated to be used with the antennas. Further, those skilled in the art will appreciate that other spiral configurations of the antenna elements of the invention may also be possible and still fall within the metes and bounds of the invention disclosed here.

Shown is a conductor backing 14 and 14' used with the spiral radiating elements. In conjunction with the two foot diameter spiral employed in research, this conductor backing comprised a three foot by three foot square. The conductor backing is separated from the spiral radiating elements by a dielectric substrate 16 and 16' having substantially flat, opposite sides. A suitable dielectric for this purpose is marketed under the trademark name of DIVINYCELL and has a dielectric constant of approximately 1. Materials with dielectric constants other than 1 could also be used to advantage.

In the research conducted and as well be further explained, this substrate was varied in thickness to ascertain its affect on polarization performance. As a result of this research, it was learned that the degree (or change in dB) to which horizontal or vertical polarization dominates depends upon the distance between the spiral radiating elements and the ground plane. To enhance a change in polarization upon a change in transmitted/or received frequency, the distance between the spiral elements and the ground plane (conductor) should be a small fraction of a wavelength of the energy radiated or received. As stated, it was also learned that the number of turns of the spiral antenna elements determines the frequency, or how rapidly, the polarization changes for a given frequency interval. The larger the number of turns the greater the degree of variability in polarization for a small change in frequency.

As previously described, an enhancement of the security of communications can be achieved by utilizing the conductor-backed spiral antennas of the invention with a frequency-hopped communication system. Referring again to FIG. 1A, a frequency-hopped transmitter 18 can be used for the input to transmitting antenna 10. Receiving antenna 10' would have the same frequency-hopping capability as its companion transmitter and both the transmitter and receiver would have the same programmed change of frequency with time.

Figure 1C:
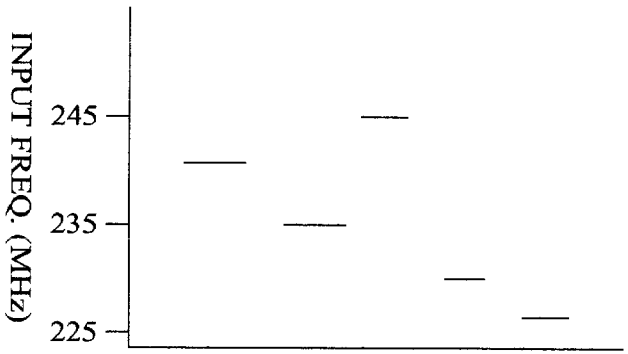
Figure 1B:
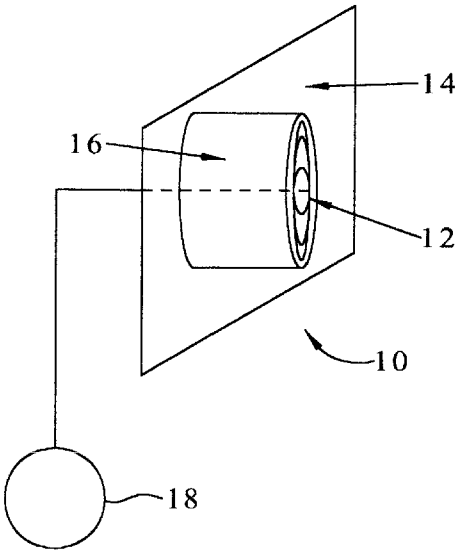
Figure 1B:
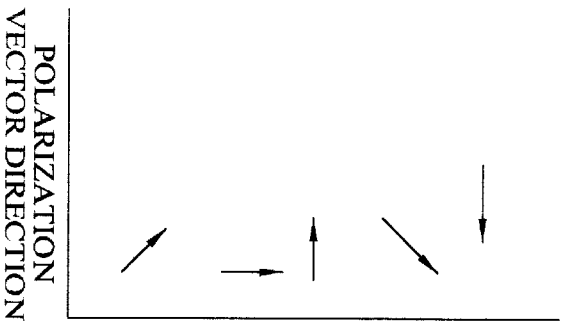
Figure 2C:
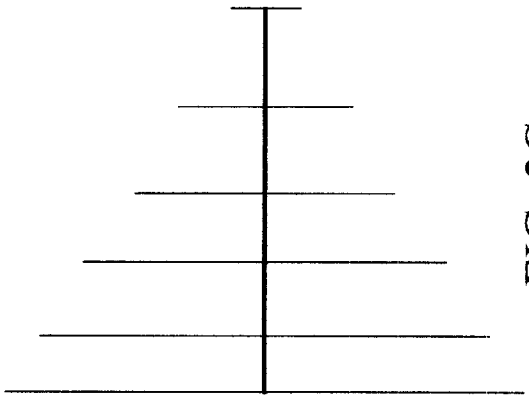
FIGS. 2A–D illustrate an exemplary schematic of an eavesdropped reception of a signal broadcast by way of the invention.
Figure 2D:
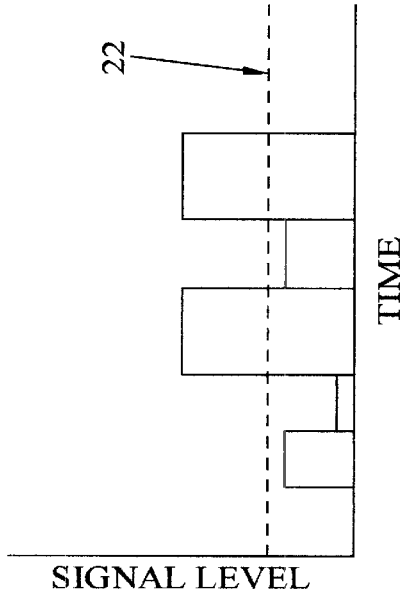
Figure 2A:
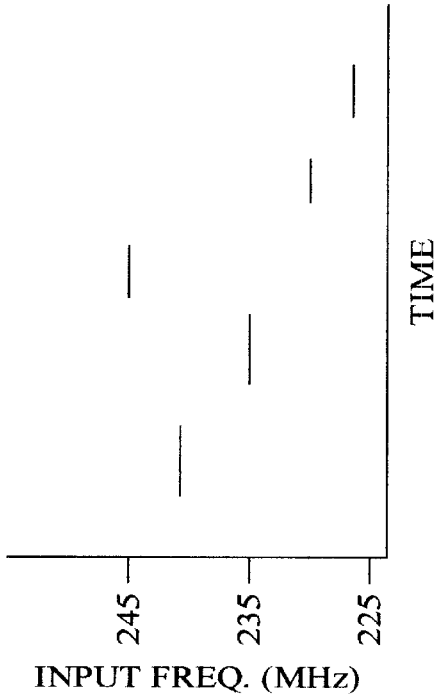
Figure 2B:
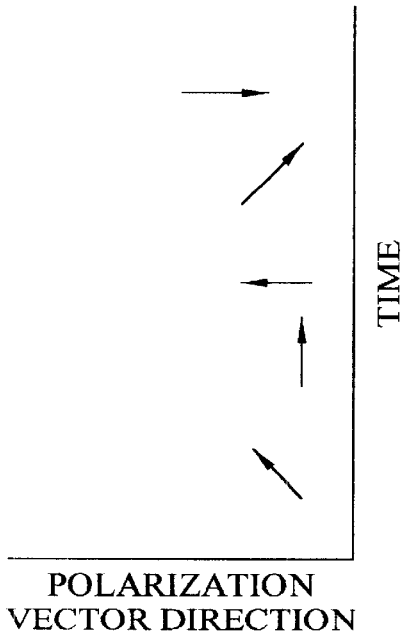

In accordance with the spiral antennas of the invention, a change in transmitting frequency to the transmitting antenna causes the polarization vector of the transmitted radiation to change. Referring to FIG. 1B, the direction to which the polarization vector points will be dependent upon the number of turns of the spiral radiating elements. FIG. 1C reflects an exemplary frequency-hopped sequence. As the receiving antenna has frequency hopping that corresponds to that of the transmitting antenna, the receiving antenna will adjust its polarization vector in sync with that of the transmitter.

Using this technique, attempts at interception will be impeded even for a broad-band eavesdropping system because of the lack of knowledge of the polarization of the transmitted signal. In this instance, the programmed change of frequency will be synchronized in time to a change in polarization.

FIG. 2 presents a description of the lack of ability of an unintended listener to intercept a signal using the method of the invention. Although the unintended listening party may have an antenna capable of detecting a signal of a very broad band, such as the vertically polarized log-periodic antenna of FIG. 2C, this antenna could not detect many of the signals that are transmitted (FIGS. 2A and 2B) due to its lack of sensitivity to polarization changes. See FIG. 2D, indicating a threshold of detection level 22. The "drop outs" of the signal would complicate interception, decryption, and possibly even signal detection finding.

Figure 3A:
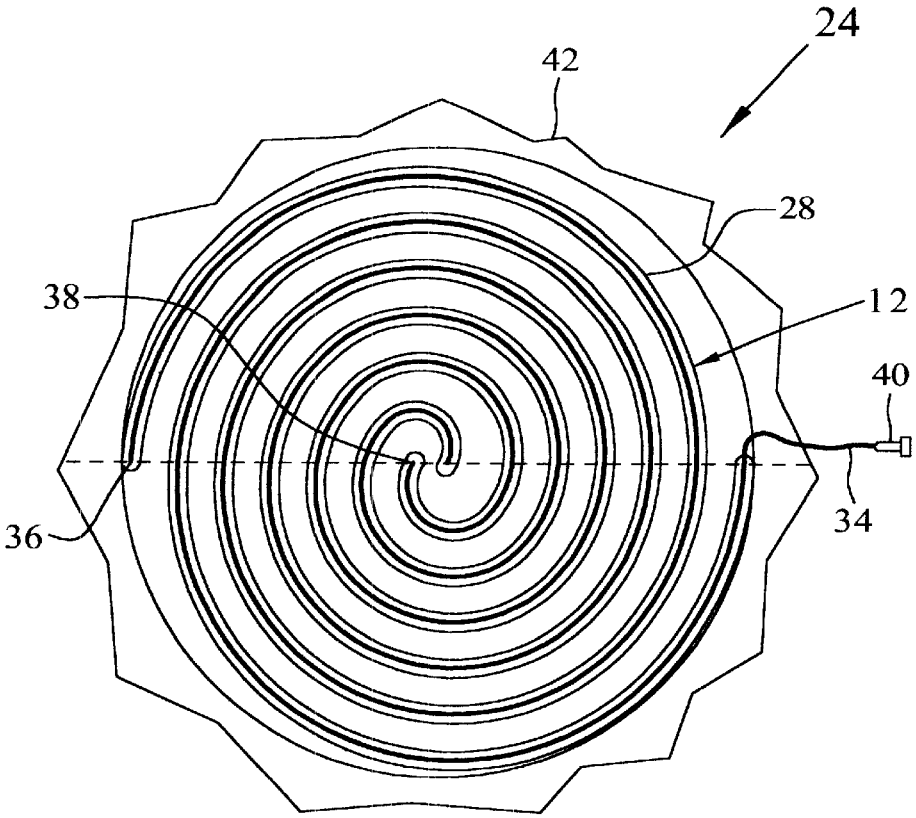
FIGS. 3A–C illustrate an exemplary conductor-backed spiral antenna as may be used in the method of the invention.
Figure 3B:
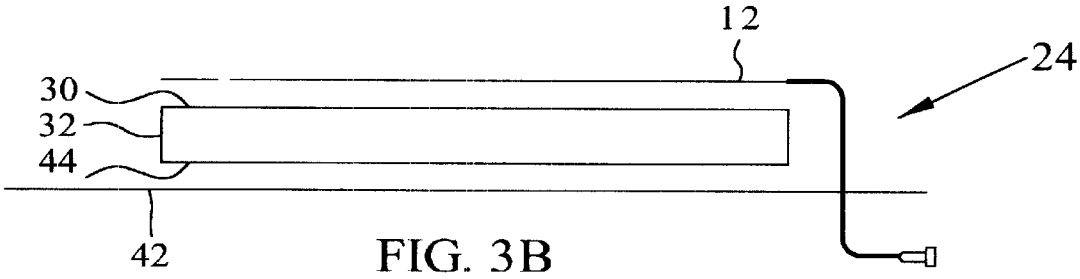
Figure 3C:
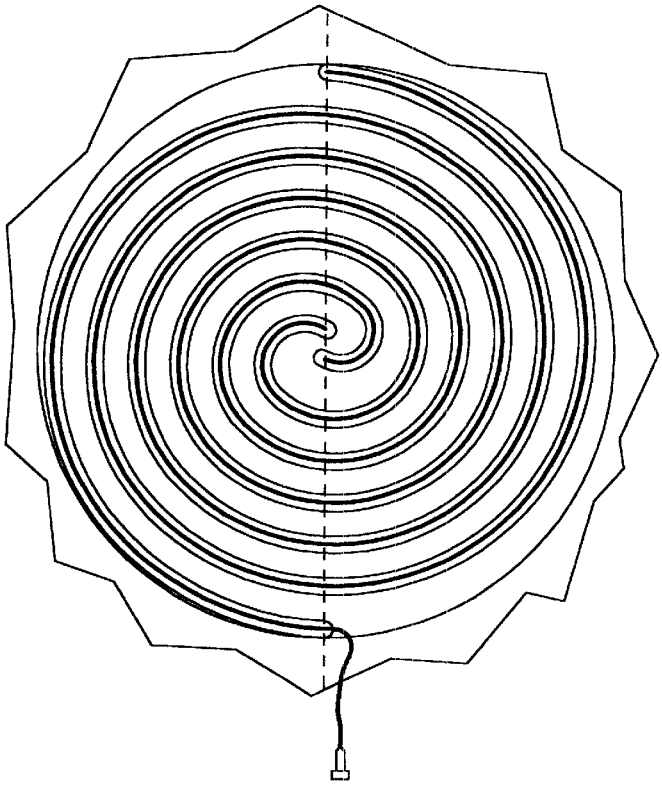
Figure 3C:
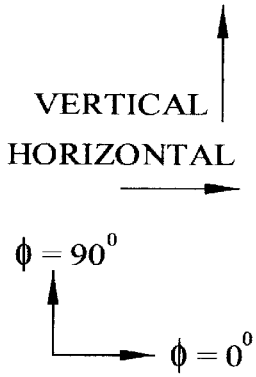

Referring now to FIGS. 3A–C, a representative conductor-backed spiral antenna 24 according to one embodiment of the invention is shown. Of, course, this representative example is meant to be used for explaining the invention and should not be considered to be the one and only way in which the invention can be accomplished or even one a few ways in which the invention can be realized.

Referring to FIGS. 3A and 3B, spiral antenna 24 is shown to comprise spiral radiating elements 12. In this example, the spiral antenna elements encompasses two arms of three turns and encompasses an outer diameter of two feet. As previously mentioned, utilization of the invention has been successful with the use of two arms. It is envisioned, however, that a greater number of arms may also provide satisfactory results. Similarly, use of three turns has shown positive results, but an increase in the number of turns has also shown satisfactory, if not improved, performance for applications of the invention. Thus the two arm, three turn spiral elements described here is by no means intended to be a limitation of the invention.

In the specific example presented, spiral elements are made up of photolithically applied conductive metal traces 28 applied to a first side 30 of a dielectric substrate 32. Attached to metal traces 28 is a coaxial cable 34. In this implementation of the invention, the outer braided grounding shield (not shown) of coaxial cable 34 is soldered to metal traces 28 at various points along the path of the traces. At outer end 36 of spiral elements 12, the inner conductor (not shown) of coax cable 34 is shorted to the outer braid of cable 34. At inner end 38 of spiral elements 12, the inner conductor of the two arms are joined and are soldered to the outer braid of the coax cable.

The radiating elements are center-fed by means of an infinite balun. Alternatively, the antenna could be edge-fed by a balun. Connector 40 provides an input/output to the antenna elements and also an energization point. As is known in the art of spiral antennas, the length of the radiating elements and accordingly their largest and smallest diameters (the gap between arms) are a function of the frequency expected to be used. As this is well understood within the art, greater details of this aspect of the antennas will not be presented here. It should also be understood that the particular feed and antenna energizations schemes discussed herein as well as the design of the spiral elements disclosed could be replaced by other configurations known in the art and still fall within the spirit of the invention disclosed here.

As can also be seen in FIGS. 3A and 3B, a conductor backing 42 is applied to a second side 44 of dielectric substrate 32, such as by way of an adhesive. In conjunction with the two foot diameter spiral radiating elements used by the Navy, this conductor backing is a three foot by three foot square. As previously described, the thickness or distance of the dielectric member between spiral radiating arms 26 and conductor backing 42 was varied to determine what affect, if any, this would have on varying the polarization of the antennas. Following is a description of the findings of this research.

A measure of the dominance of one polarization over another is known as an axial ratio. Referring to FIG. 3C, a legend is shown corresponding to this measurement. One measure of the signal is its gain in decibels (dB). The axial ratio can be defined as the difference in gain between vertical and horizontal polarization at a particular frequency (GAIN (V)−GAIN(H)). An antenna with circular polarization is considered to have an exial ratio of near 0 dB.

Figure 4:
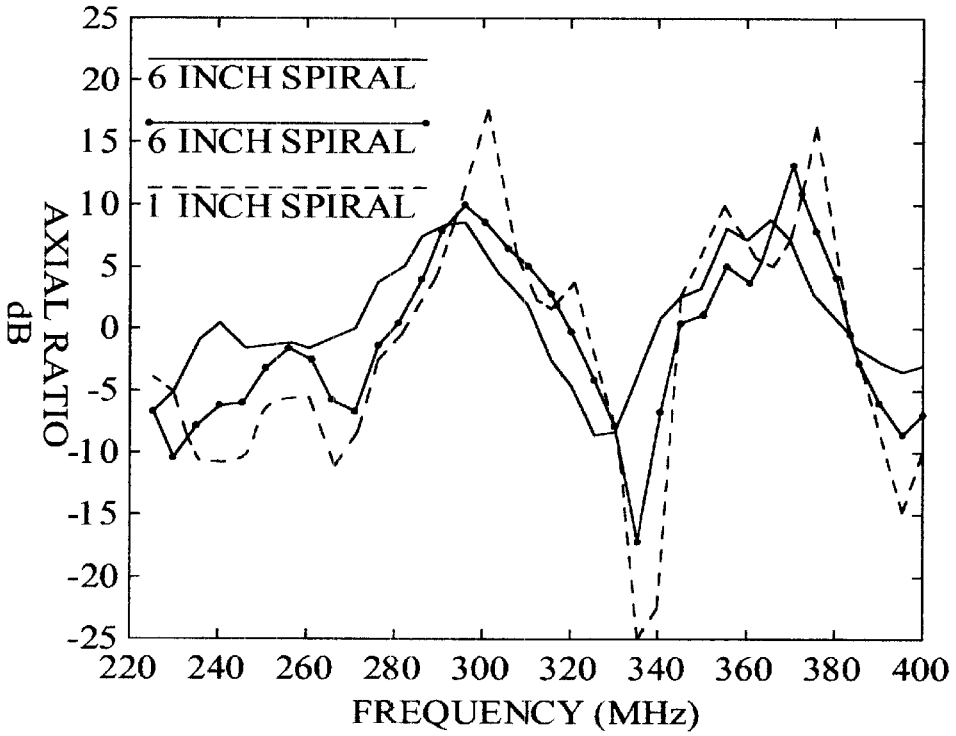
FIG. 4 presents data on the axial ratio collected on three-turn conductor-backed spiral antennas as a function of frequency between 225 MHZ and 400 MHZ for spiral antennas having 6 inch, 3 inch and 1 inch thick dielectric spacing.

FIG. 4 presents data on the axial ratio for a three-turn, 1, 3 and 6-inch thick dielectric spiral as a function of frequency between 225 and 400 MHZ. This data was obtained at 5 MHZ frequency intervals at the Space and Naval Warfare Systems Center antenna range located in San Diego, Calif. Each three-turn spiral antenna had a frequency difference between successive maximums between 70 and 75 MHZ.

The 6-inch thick spiral had a difference between maximum and minimum for an axial ratio of 17.15 dB. The 3-inch thick spiral had a corresponding difference of 30.45 dB. The difference for the 1-inch thick spiral was 42.59 dB. This data of course indicates that the thinner dielectric substrate provides the most pronounced change in gain between polarizations, and suggests that minimizing the substrate thickness will accentuate a change in polarization as frequency increases.

Figure 5:
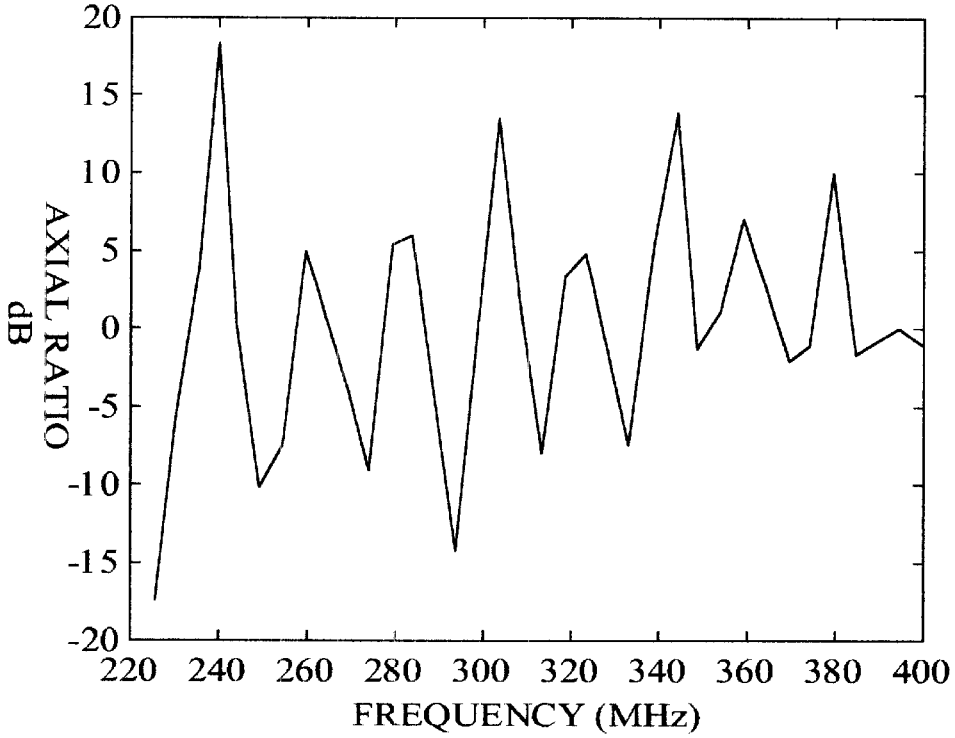
FIG. 5 presents data for the axial ratio collected on a ten-turn conductor-backed spiral antenna as a function of frequency between 225 HZ and 400 MHZ in which the spiral antenna has a 1 inch thick dielectric spacing.

FIG. 5 presents data for the axial ratio of a ten-turn, 1-inch thick spiral. The additional turns can be applied and connected as with the three turn embodiment of the invention. The data shows a rapid variation in polarization change as a function of frequency. The difference between maximum and minimum was found to be 36.47 dB.

Figure 6:
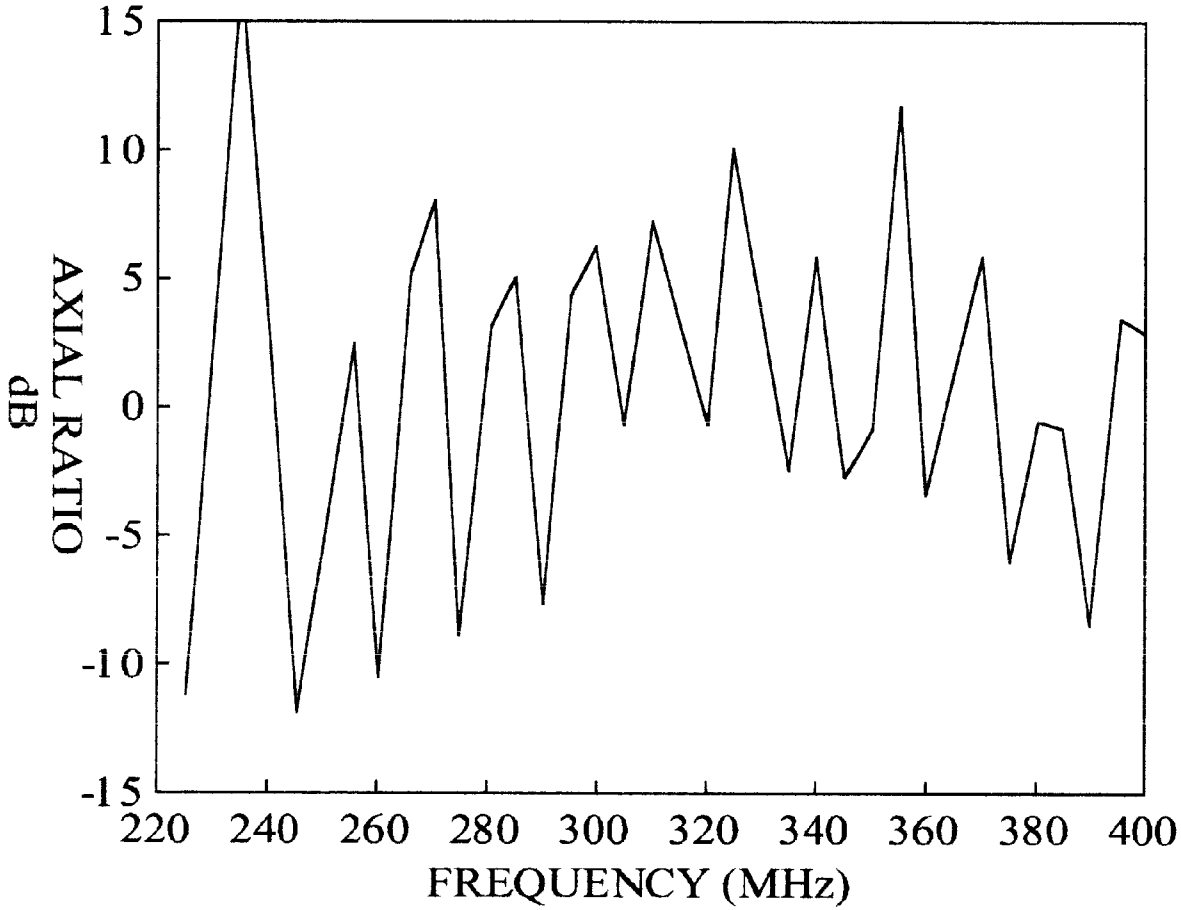
FIG. 6 presents data for the axial ratio collected on a twelve-turn conductor-backed spiral antenna as a function of frequency between 225 HZ and 400 MHZ in which the antenna has a 3 inch thick dielectric spacing.

FIG. 6 presents the axial ratio for a twelve-turn, 3-inch thick dielectric spiral antenna. As with the other embodiments of the invention, the additional turns can be similarly applied and connected. Measurements were obtained at frequency intervals of 1 MHz. The frequency difference between successive maximums was 18 MHZ, a factor of 4 smaller than the three-turn spiral. The difference between maximum and minimum was 32.4 dB.

The characteristics of the spiral antennas described can be exploited in a frequency-hopped system wherein the frequency follows a preset pattern known to both the transmitter and intended receiver. Due to the nature of the spiral antennas, the polarization of the transmitted signal will also change upon a change in frequency. Even a broadband interception system, if linearly polarized, would not detect most of the signals transmitted due to the rapid change in the polarization vector. Any interception system to be effective would have to be both broad band and sensitive to both types of polarization. Even in this case, the lack of correspondence of polarization will lead to inefficiency of interception.

A system according to the invention would also have advantages in preventing jamming of a signal. While white noise could jam a signal whose polarization remained constant while frequency changed, the frequency and polarization diversity according to the invention would complicate the jamming task of a potential adversary. The use of polarization diversity would also complicate the "locking on" to a signal by an unintended party.

The polarization diversity described herein could also be accomplished electronically by synchronizing the phase of two orthogonal, linearly polarized, antennas to frequency. Because of the "active" nature of this arrangement, the electronically controlled polarized antenna would eventually suffer from reliability problems.

In the conductor-backed spiral antenna approach of the invention, such polarization changes are conducted passively, as polarization changes occur automatically as frequency changes.

Obviously, many modifications and variations of the invention are possible in light of the above teachings. It is therefore to be understood that within the scope of the appended claims the invention may be practiced otherwise than as has been described.

What is claimed is:

1. A communication method comprising:

transmitting a frequency-hopped communications signal from an antenna radiator that changes polarization with a change in frequency;

receiving said frequency-hopped communications signal on an antenna receiver that has frequency-polarization characteristics matched to said antenna radiator and that is synchronized with said frequency-hopped communications signal as transmitted;

wherein said antenna radiator and receiver are conductor-backed spiral antennas each comprising:

a substrate with first and second substantially flat, opposite sides;

at least one pair of spiral antenna elements disposed on said first side of said substrate; and a conducting ground plane disposed on said second side of said substrate.

2. The method of claim 1 wherein the performance of each of said antennas is described by an axial ratio defined as the difference between vertical gain and horizontal gain at a particular frequency and wherein said axial ratio varies by no less than plus or minus 5 dB.

3. The method of claim 2 wherein said spiral antenna elements makes at least three 360 degree turns.

4. The method of claim 3 wherein said substrate separates said spiral antenna elements from said conducting ground plane by a distance that is no greater than 6 inches.

5. The method according to claim 4 wherein said antennas operate between 225 megaHertz and 400 megaHertz.

6. The method of claim 3 wherein said substrate separates said spiral antenna elements and said conducting ground plane by a distance that is no greater than 3 inches.

7. The method of claim 6 wherein said antennas operate between 225 megaHertz and 400 megahertz.

8. The method of claim 3 wherein said substrate separates said spiral antenna elements and said conducting ground plane by a distance that is no greater than 1 inch.

9. The method according to claim 8 wherein said antennas operate between 225 megaHertz and 400 megaHertz.

10. The method of claim 2 wherein said antenna elements comprise metal foil.

11. The method of claim 10 wherein said antenna elements are arranged in an Archimedean spiral pattern.

12. The method of claim 10 wherein said substrate has a dielectric constant of approximately 1.

13. A communication method comprising:

transmitting a frequency-hopped communications signal from an antenna radiator that changes polarization with a change in frequency;

receiving said frequency-hopped communications signal on an antenna receiver that has frequency-polarization characteristics matched to said antenna radiator and that is synchronized with said frequency-hopped communications signal as transmitted;

wherein said antenna radiator and receiver are conductor-backed spiral antennas each comprising:

a substrate with first and second substantially flat, opposite sides;

at least one pair of Archimedean spiral-shaped antenna elements disposed on said first side of said substrate, said spiral elements making at least three 360 degree turns; and a conducting ground plane disposed on said second side of said substrate, wherein said substrate separates said spiral antenna elements from said conducting ground plane by a distance that is no greater than 6 inches.

14. The method of claim 13 wherein the performance of each of said antennas is described by an axial ratio defined as the difference between vertical gain and horizontal gain at a particular frequency and wherein said axial ratio varies by no less than plus or minus 5 dB.

15. The method of claim 14 wherein said antenna elements comprise metal foil.

16. The method of claim 15 wherein said substrate has a dielectric constant of approximately 1.

17. The method according to claim 16 wherein said antennas operate between 225 megaHertz and 400 megaHertz.

* * * * *